United States Patent [19]

Blomqvist et al.

[11] 4,022,132

[45] May 10, 1977

[54] PASSIVE INFRA-RED PROXIMITY FUZE

[75] Inventors: Åke Hugo Petrus Blomqvist; Bertil Torbjörn Eriksson, both of Karlskoga, Sweden

[73] Assignee: AB Bofors, Bofors, Sweden

[22] Filed: June 17, 1975

[21] Appl. No.: 587,568

[30] Foreign Application Priority Data

June 25, 1974 Sweden ..... 7408307

[52] U.S. Cl. ..... 102/70.2 P

[51] Int. Cl.[2] ..... F42C 13/02

[58] Field of Search ..... 102/70.2 P; 343/7 PF

[56] References Cited

UNITED STATES PATENTS

| | | | |
|---|---|---|---|
| 2,060,205 | 11/1936 | Hammond, Jr. | 102/70.2 P |
| 3,242,339 | 3/1966 | Lee | 102/70.2 P |
| 3,727,553 | 4/1973 | Godfrey | 102/70.2 P |
| 3,786,757 | 1/1974 | Goldstein et al. | 102/70.2 P |
| 3,793,958 | 2/1974 | Holt et al. | 102/70.2 P |

*Primary Examiner*—Charles T. Jordan
*Attorney, Agent, or Firm*—Pollock, Vande Sande & Priddy

[57] ABSTRACT

Apparatus for use in a projectile-borne passive infra-red proximity fuse for detecting infra-red radiation emitted from a target. The apparatus includes at least one pair of optical means which are respectively located at spaced locations around the periphery of the projectile. The pair of optical means is so located that the beams of infra-red radiation associated therewith, which are both imaged upon a common detector, form an angle therebetween both in a plane through the longitudinal axis of the projectile and in a plane normal to such axis. Logic circuitry is provided and controlled by the detector to provide a distinctive output in response to the signals which are generated by the beams of radiation received from a target which is spinning about its longitudinal axis and is within a predetermined distance of the projectile. With the arrangement as described, the detection apparatus produces either two separate pulses or one long pulse for each revolution of the projectile about its longitudinal axis, whereas only a single pulse is produced for each revolution from distant sources of infra-red radiation such as the sun.

2 Claims, 6 Drawing Figures

PASSIVE INFRA-RED PROXIMITY FUZE

BACKGROUND OF THE INVENTION

The present invention relates to a device for detection of infrared rays, and particularly a device of the kind that initiates the ignition of an explosive charge when the device is in the vicinity of a target that emits infrared radiation. Such devices are previously known, and are called passive IR proximity fuzes, and are intended to be included in projectiles, for example, that move with a high velocity towards the target.

One of the problems involved with such a device is to distinguish between solar radiation and the IR radiation emitted from the target, as the sun constitutes a very strong source of radiation in the IR range. It is, indeed, known in the art to make proximity fuzes that can carry out this operation. Two diverging coaxial rotation-symmetrical conical fields of view are then utilized, and a target passage is then characterized in that the IR radiation caused by translational movement of the projectile in relation to the target is received in both fields of view in rapid succession, while the divergence between the fields of view has the result that sources of radiation at great distances (the sun) can only be perceived in one of the fields of view. The fields of view are then comprised in separate receiver channels.

SUMMARY OF THE INVENTION

The present invention relates to a simpler and cheaper IR proximity fuze, which works with one or several pairs of fields of view. Contrary to previously known devices, only one receiver channel is then used, which is common for all fields of view. Through a special arrangement of the fields of view, in response to the rotation of the projectile, a modulation of the IR radiation received is obtained, and thereby of the detected signal, and this modulation then has clearly distinguishable properties when a target passes at a short distance, compared with what is obtained from a source of radiation at a great distance. Previously known embodiments of passive IR fuzes have utilized the translational movement of the projectile in relation to the target, and not its rotary movement, in order to give detector signals which make it possible to detect the target in the presence of interference sources. The detector is appropriately of such a type that it is sensitive to IR radiation within a wavelength interval where the radiation from distant sources will be considerably damped in the atmosphere, e.g. 5.5 – 7 $\mu$m.

The device according to the invention is characterized by one or several pairs of fields of view, distributed around the periphery of the projectile, the optical axes of which in pairs form an angle to each other both in a plane through the longitudinal axis of the projectile and in a normal plane to this axis, and arranged to pick up and, via an optical device, to transmit the infrared radiation received to a common detector device which emits a signal to a common amplification and detection channel. Through such a distribution of the fields of view, the sun and other interference sources at a great distance can be discriminated against, so that they do not produce any initiation signal. By permitting several fields of view to share the same amplification and detection channel, the device will be cheaper, and will not require as much space as previously known devices, which is highly essential as the projectile can thereby carry a larger payload. The device is moreover characterized by a logic circuit in the detection channel, which emits an output signal only when certain conditions as regards the modulation of the detector signal have been fulfilled.

BRIEF DESCRIPTION OF THE DRAWINGS

In the following, the invention will be described in more detail, with reference to the accompanying figures, in which.

DETAILED DESCRIPTION OF THE PREFERRED EMBODIMENT

Figure 1:
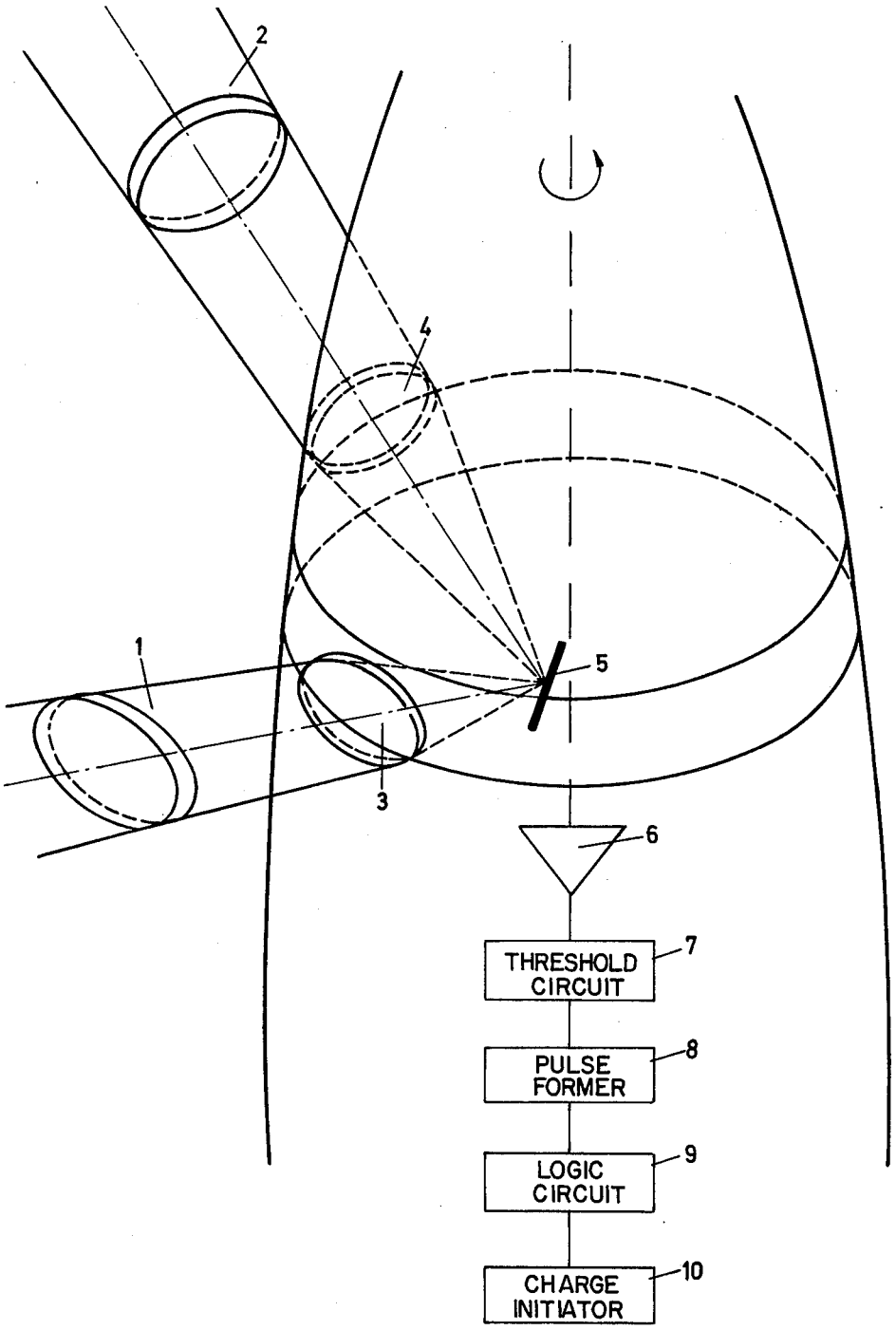
FIG. 1 shows schematically the optical device with one pair of fields of view and detection circuits.
Figure 2:
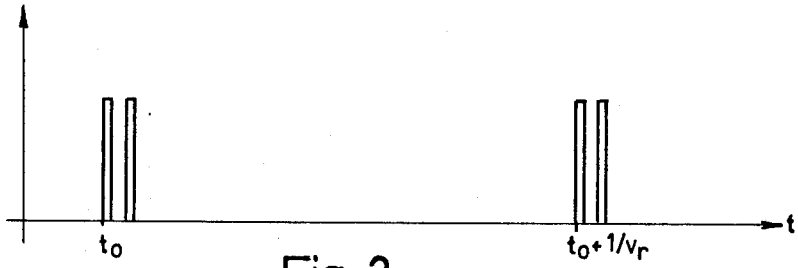
FIG. 2 shows the signal which is generated by the detector when a small target is passed at a relatively short distance, with one pair of fields of view.
Figure 3:
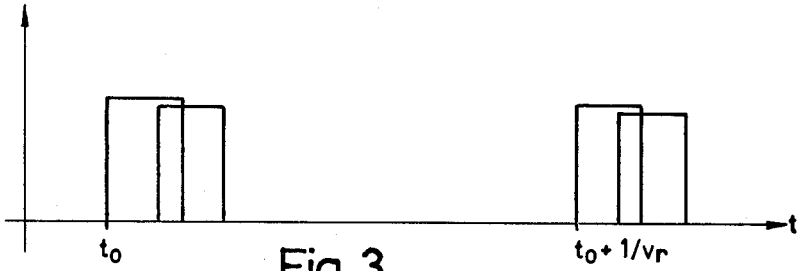
FIG. 3 shows the same signal when a relatively large target passes at a short distance, with one pair of fields of view.
Figure 4:
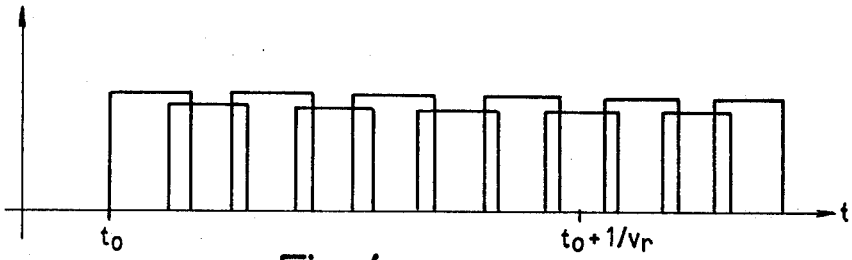
FIG. 4 shows the signal generated by the detector when the proximity fuze is provided with many pairs of fields of view and the target is passes at a relatively short distance.
Figure 5:
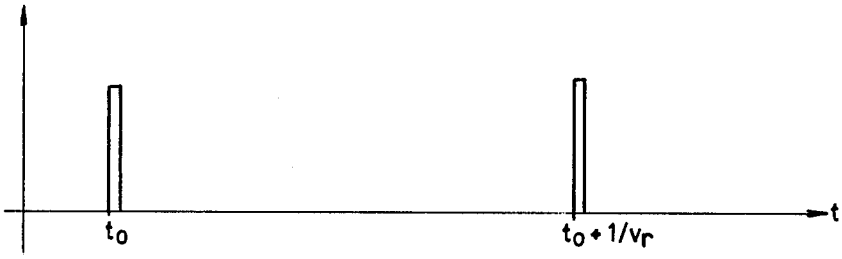
FIG. 5 shows the signal generated in the detector by an interference source at a great distance, e.g. the sun, with one pair of fields of view.

The projectile according to FIG. 1 which, in a known way, rotates in its trajectory, receives IR radiation from the target in the form of two beams of radiation, which are determined by the fields of view 1, 2 of the receiving optics. The optics 3, 4 collect the irradiation and transmit this to receiving equipment which consists of a common detector 5 and amplification and detection circuits 6–10. The beams of radiation (and the fields of view) in pairs form an angle to each other both in a plane through the longitudinal axis of the projectile and in a normal plane to this axis. The former angle is then chosen in such a way with consideration to each particular application that a distant source of radiation e.g. the sun, can come within the field of view of only one of the apertures in the pair of fields of view, while the projectile is in its trajectory. On the other hand, a source of radiation close by, e.g. the target, passes through both fields of view in rapid succession. The signal which is generated by the detector when passing such a source of radiation close by will consist of two pulses in rapid succession per pair of fields of view and revolution, which possibly overlap each other in time when they are fed to the detector (see FIGS. 2–4). On the other hand, the signal from a distant source of radiation, e.g. the sun, will consist of one short single pulse per pair of fields of view and revolution (see FIG. 5). In FIGS. 2–5, $t_o$ designates the time for the first pulse and $v_r$ the rate of spin of the projectile. The conditions for detection will therefore be that either at least two pulses per revolution and pair of fields of view must be received, or that the detector pulse must exceed a certain length.

The signal emitted from the detector 5 is fed via an amplifier 6, a threshold circuit 7 and a pulse-forming circuit 8 to the logic circuit 9. If the condition for detection has been fulfilled, the logic circuit 9 will emit a signal which is fed to members 10 for producing the initiation of the charge carried by the projectile.

For increased resolution, it is also possible to provide the projectile with several pairs of fields of view, distributed along the periphery of the projectile, and either a common detector or a number of separate detectors can then be used. In the latter case, however, all of the detectors are connected to the same amplification and detection channel.

When the projectile is provided with several pairs of fields of view, at short distances between the target and the projectile, the target will possibly give a signal from the detector as long a time as the target and projectile are on a level with each other. Such a pulse will then obtain a maximum length of approx. 1/v sec., where 1 is the extent in length of the target and $v$ the relative speed between the target and the projectile. With $1 =$ 25 m and $v = 500$ m/s, the detector can thus emit one long pulse which is 50 ms when passing the target. On the other hand, with a field of view of 10° and with a rate of spin of the projectile of 1000 r.p.s. and a transversal dimension of the target of 0.5 m one detector pulse per field of view of approx. 0.05 ms at a distance to the target of 10 m is obtained. A spot source at a great distance can give rise to a pulse of the latter size.

To summarize, it can thus be stated that the target pulses generally have a duration of T s, in which $$5 \cdot 10^{-5} < T < 50 \cdot 10^{-3}\ s$$

while the "sun pulses" have a duration of $T \leqslant 5.10^{-5}\ s$. However, with the detection condition of at least two pulses per revolution and pair of fields of view, such a "sun pulse" will not initiate the charge, as it only occurs once per revolution.

Figure 6:
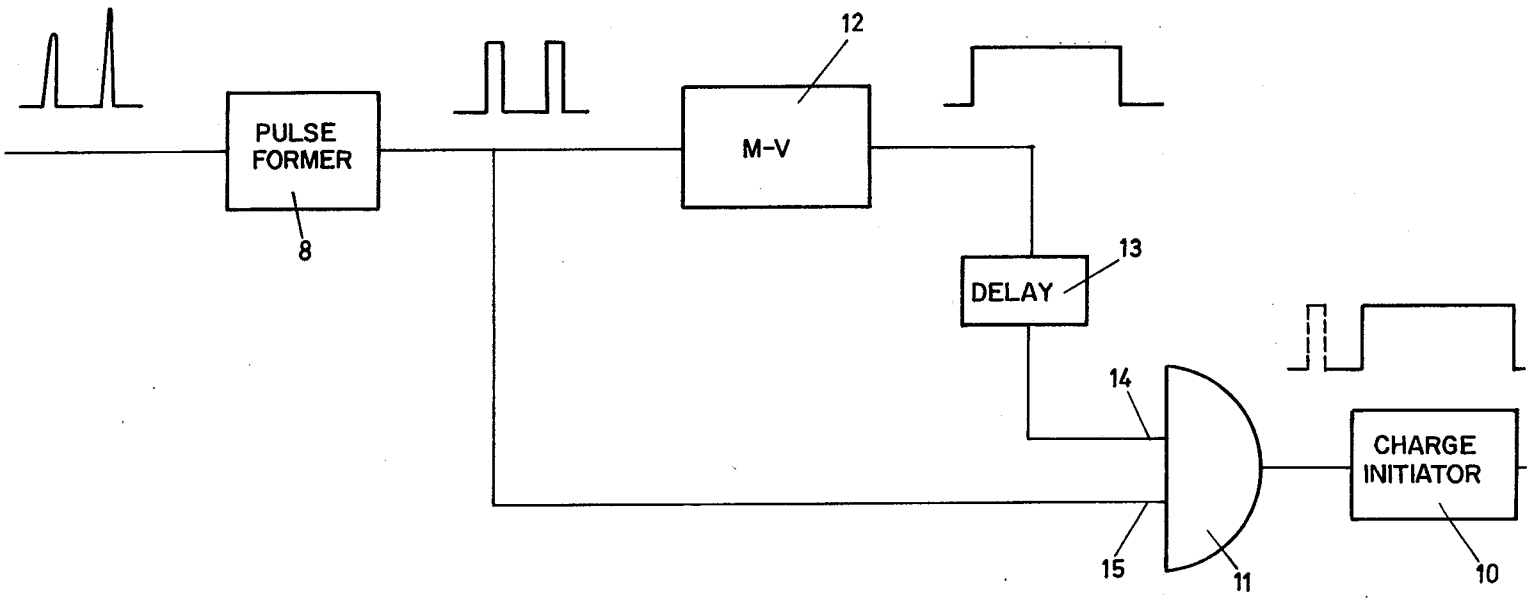
FIG. 6 shows a possible embodiment of the logic circuit.

An embodiment of the logic circuitry is shown in FIG. 6. In the pulse-forming network 8 pulses which have passed the threshold circuit 7 shown in FIG. 1, are given an appropriate length and amplitude. After the pulse-forming network, the signal is conveyed via two different ways to an AND gate 11. A part of the signal triggers a holding circuit in the form of a multivibrator 12. The multivibrator may be followed by a delay circuit 13 with a delay of $\tau$ s chosen in such a way that the pulse from the multivibrator does not reach input 14 of the AND circuit while it is still on a level corresponding to a short "sun pulse" which is applied to input 15 of the AND circuit 11 directly from network 8. The multivibrator has a holding time which is shorter than $1/(v_r.n)$ in which $v_r$ is the rate of spin of the projectile and $n$ the number of pairs of fields of view. One double pulse or one long pulse corresponding to a target being passed at a short distance then gives a signal simultaneously on both inputs to the AND circuit 11 while this is not the case of a "sun pulse". The invention is not limited to the embodiment described above, but various modifications are possible within the scope of the invention, particularly as regards the design of the optical device and the logic circuit.

We claim:

1. Apparatus for use in a projectile-borne passive infra-red proximity fuse to detect infra-red radiation emitted from a target comprising:

detector means, at least one pair of optical means respectively located at spaced locations around the periphery of the projectile, each of said optical means imaging on said detector means the infra-red radiation from the target which radiation travels along a predetermined axis, the axes of said at least one pair of optical means forming an angle relative to each other both in a plane through the longitudinal axis of the projectile and in a plane normal to such axis, said detector means producing an output signal in response to the imaging thereon of radiation by either of said at least one pair of optical means, and means controlled by said detector means to a distinctive condition in response to the radiation imaged upon said detector means by both said optical means from said target while said projectile spins about its longitudinal axis and is within a predetermined distance of the target.

2. The apparatus of claim 1 wherein said controlled means is controlled to its said distinctive condition only when said detector means receives radiation along both said axes of said pair of axes within a predetermined time or receives an output from said detector means whose duration exceeds a predetermined value.

* * * * *